United States Patent [19]

Harper, Jr. et al.

[11] 3,960,477

[45] June 1, 1976

[54] CROSSDYED COTTON FABRICS

[75] Inventors: Robert J. Harper, Jr., Metairie; Eugene J. Blanchard, New Orleans; John T. Lofton; Gloria A. Gautreaux, both of Metairie, all of La.

[73] Assignee: The United States of America as represented by the Secretary of Agriculture, Washington, D.C.

[22] Filed: Jan. 11, 1974

[21] Appl. No.: 432,800

[52] U.S. Cl. ..... 8/15; 8/1 E; 8/17; 8/18; 8/19; 8/66

[51] Int. Cl.[2] ..... D06P 1/38; D06P 3/60; D06P 5/12

[58] Field of Search ..... 8/15, 18, 66, 19

[56] References Cited

UNITED STATES PATENTS

| | | | |
|---|---|---|---|
| 1,376,569 | 5/1921 | Noll | 8/14 |
| 3,775,046 | 11/1973 | Harper et al. | 8/17 |
| 3,800,375 | 4/1974 | Harper et al. | 8/18 |
| 3,847,542 | 11/1974 | Harper et al. | 8/18 |

*Primary Examiner*—Ronald W. Griffin
*Attorney, Agent, or Firm*—M. Howard Silverstein; Salvador J. Cangemi

[57] ABSTRACT

This invention relates to a process for producing crossdyed cotton fabrics. For this purpose, by means of a chemical technique, procedures which permit the dyeing of selective yarns in a fabric have been developed.

2 Claims, No Drawings

CROSSDYED COTTON FABRICS

This invention relates to the dyeing of cotton and other cellulosic containing fabrics in such a manner as to produce crossdyed fabrics. By crossdyeing is meant, a procedure by which when the fabric is dyed via immersion dyeing, certain yarns are dyed one color while other yarns in the fabric are dyed a second color.

Cotton is at a disadvantage in certain competitive markets because certain synthetic fibers such as polyester can be prepared so that they can be dyed with either disperse or basic dyes. By proper selection and placement of these fibers in a fabric, crossdyed effects can be readily achieved.

In order to produce a crossdyed cotton fabric, a procedure has been developed by which certain yarns in the fabric have been made dye resistant. These dye resistant yarns are woven into a fabric with untreated yarns in a regular pattern. The fabric is then dyed. At this point, the untreated yarns dye deeply while the dye-resist yarns dye to a very limited extent. Then, the dye resistance of the yarns is removed and the entire fabric is dyed a second time. The formerly dye-resist yarns acquire the color of the dye used in the second dyeing, while the original non dye resist (untreated yarns) are dyed a color equivalent to the color of a combination of the two dye colors.

At this time, it might be well to indicate the means by which dye resistance is achieved. The yarns that are to be made dye resist are treated with an easy to hydrolyze crosslinking agent such as dimethylethyleneurea or dimethylolpropyleneurea. The agent is applied to the yarns, the yarns are woven into fabric, the fabric is cured, then dyed, the agent is hydrolyzed and the fabric is redyed. The one special aspect of this procedure which must be taken into consideration is the question of size used to permit weaving. Variations from normal textile practice are required to permit the process to be effective. A mroe complete description of these variations will be given subsequently.

COLOR VARIATIONS

An important aspect of this procedure is the concept of building color via two dyeings. As such if a dye is a common component in the dye mixture in both the first and second dyeings, it should be used only once and that in the second dyeing. For example, fabric dyed with a dye mixture of red and yellow produces an orange fabric. Thus fabric woven from a dye resistant warp and an untreated fill is dyed with Reactive Red 1. Then the dye resistance is removed from the warp and the fabric is redyed with Reactive Yellow 22. The result is a crossdyed fabric in which the warp is dyed yellow and the fill is dyed orange (combination of red and yellow). Similarly, green is a combination of blue and yellow. A repeat of the above procedure only using Reactive Blue 4 in the initial dyeing and Reactive Yellow 22 in the second dyeing yields a crossdyed fabric in which the warp is dyed yellow and the fill is dyed green (combination of blue and yellow). In general, this type of procedure can be varied innumerable ways to produce myriad of color combinations. However, the general rule is to use dye combinations so that the deep shades are produced on the non dye resistant yarns while the lighter or more pastel shades are produced on the yarns that are initially dye resistant.

TREATMENT TO PRODUCE DYE RESISTANCE

The first step in this procedure is the treatment to produce dye resistance. Dye resistance is achieved by using a crosslinking treatment. The level of treatment to be utilized will depend to a certain extent on the conditions of the yarns to be treated. For example, if bleached yarns are used, a level of treatment consisting of 4-10% dimethylol ethyleneurea with an appropriate acid catalyst is employed. Examples of such catalysts are zinc nitrate hexahydrate, magnesium chloride or citric acid. If grey cotton yarns are used, the absorption of crosslinking agent is somewhat less effective. As such for this a treatment level varying from 6–12% dimethylolethyleneurea can be employed. With grey yarns it is also advisable to utilize a higher concentration of wetting agent. For best color delineation, bleached yarns should be used but the method is also amenable to the use of grey yarns. With respect to mode of treatment, filling yarns can be treated either in skein form or in a package dye machine using tubes of yarn. With respect to the warp yarns, the crosslinking treatment can be added in conjunction with the size in slashing. Combinations of DMEU (dimethylolethyleneurea) and starch or DMEU and PVA (polyvinylalcohol) can be used. Because the crosslinking agent reacts both with the size and cellulose, a larger than normal concentration of DMEU should be used. Thus, a treatment might consist of 8–12% dimethylolethyleneurea and 4% PVA or 8–12% DMEU and 12% thin boiling starch or 9% modified starch. These treatments would be put on in the slashing operation. The yarns would be dried but curing of the crosslinking agent would be delayed until after the fabric is woven.

INTERPLAY OF CROSSLINKING AGENT AND SIZE

At this juncture, a closer look at the chemical interplay between size and crosslinking agent might be appropriate. For example, if one wishes to use a DMEU treated filling with an untreated warp, several variations might be considered. In the first case, one uses a starch sized warp and a DMEU treated filling. The fabric is woven, cured, and then washed to remove catalyst. At this point, the initial dyeing is performed. The DMEU is hydrolyzed and the fabric is redyed. Desizing may be performed after the initial dyeing, after the acid hydrolysis or after the second dyeing. The desired crossdyed effect is lost, however, if desizing is done prior to the initial dyeing. This is normal in textile practice, but experiments show that the DMEU is stripped out in the starch desizing which utilizes enzymes.

In the second case, one uses PVA sized warp and a DMEU treated filling. The fabric is woven, cured and then washed to remove catalyst and size. After this the standard procedure of bye, hydrolyze and redye is employed.

In the case in which the DMEU is used in the warp, the agent is applying in slashing. If two ply yarns are used, no size is employed and the process is simplified. Under these circumstances the warp is padded with DMEU, dried, woven into fabric, cured and washed. Then the normal dye, hydrolyze and redye procedure is employed. If the fabric consists of a treated dye resistant warp and an untreated filling and singles yarns are used in the warp a different procedure must be employed. This consists of sizing the warp with a mixture of starch and DMEU or PVA and DMEU. The fabric is woven using an untreated filling, then the fabric is recured and rewashed to remove catalyst. The initial dyeing is now performed, then the DMEU is hydrolyzed. At this point the remaining size is removed from the fabric using hot water in the case of PVA or enzyme in the case of starch. It should be noted that the overall process differs from normal textile practice in that desizing is performed after the initial dyeing and hydrolysis. This is necessitated by the fact that the crosslinking agent forms chemical bonds with the sizing agents and its removal must be delayed until the point at which the crosslinking agent is being or has been removed from the fabric.

PATTERN DESIGN

Thus far, cases in which either all the filling yarns or all the warp yarns have been made dye resist, thus leading to a simple check pattern in the dyed fabrics have been discussed. However, more complicated patterns such as stripes or large checks can be produced if this is desired. All that is required is that a mixture of DMEU treated and untreated yarns be used in a patterned effect. For example, one fabric was woven using a pattern in filling yarns consisting of 1 inch of treated yarns and one inch of untreated yarns. After the appropriate dyeing process had been completed on this fabric, a fabric was produced which consisted of one inch latteral stripes in which one inch was the solid color produced by double dyeing and the second inch was a stripe check in which the warp yarns were double dyed and filling yarns were dyed only with the second color.

In a second variation, the opposite effect can be achieved if this same approach is used in the warp (that is, two beams are prepared). One is sized with DMEU and stored while the second one is sized with starch only. These are then meshed together so that the warp of the fabric consists of one inch segments alternating between starch size only and yarns sized with DMEU and starch. After completion of the finishing and dyeing cycles, a stripe pattern similar to the prior case is produced, only in this case the stripes are running in the warp direction of the fabric. A more complex pattern can be produced if one uses alternating treated and untreated yarns in both warp and fill. Under these circumstances a larger checked pattern emerges in which some squares are double dyed in both warp and fill, some squares are single dyed in warp and fill and some squares are double dyed in warp or fill and some squares are double dyed in warp or fill and single dyed in the other yarn. These patterns are representative samples of what can be accomplished using a few simple variations in yarn arrangements. Other patterns could be readily made using other variations in yarn arrangement.

HYDROLYSIS OF AGENT

An important step in the overall process is the hydrolysis of agent. This takes place subsequent to the initial dyeing. As such, this hydrolysis must remove the crosslinking agent and color or coated yarns without harming the fabric color imparted by the initial dyeing. It has been found that certain fabrics dyed with certain reactive dyes (such as blues and browns) are more susceptible to discoloration and spotting than others. Because of this, a hydrolysis procedure consisting of immersion of the sample in a bath at 46°–50°C containing 0.25% hydrochloric acid for a period of 6 minutes works best.

If further hydrolysis is needed, the sample may be washed and hydrolyzed in a similar bath for an additional 3–6 minutes. Samples dyed in colors less susceptible to acid damage may be hydrolyzed using baths at high temperatures (60°–70°C) and at higher concentration of acid (up to 1% HCl). While experimental work has been performed with dilute hydrochloric acid, a bath prepared using other acids such as phosphoric, sulfuric or citric acid can be used.

DYEING PROCEDURES

A part of the interrelationship of colors and concept of building colors, it might be noted that in this process reactive dyes were used. Dyeing was done by the procedure recommended by the dye manufacturer, which consists of immersion dyeing using a basic catalyst. Examples of reactive dyes used in this procedure and Reactive Red 1, Reactive Orange 4, Reactive Yellow 22, Reactive Yellow 1, Reactive Blue 41 and Reactive Brown 10. With respect to dye concentrations, in the initial dyeings, dye concentrations were from 0.5 to 1.0% while in the second dyeings dye concentrations ranged from 0.05 to 0.5%. Deep colors should be used in the initial dyeing, while more pastel colors should be used in the second dyeing.

ADDITIONAL CONCEPTS

While this concept has been written for woven goods, it is also amenable to knit goods. Thus, a fabric could be knitted using alternate stripes of treated and untreated yarns. Then it could be processed and dyed to yield a variety of multicolor knits from the same basic fabric. Likewise in woven goods, the method could be particularly effective for certain pile type fabrics such as towels with warp stripes and corduroy with filling stripes. Extensive variations of this procedure can be made by anyone skilled in the art to produce crossdyed cotton and other cellulosic fabrics.

EXAMPLE 1

Several skeins of untreated bleached cotton yarns were padded to 60% wet pickup with a solution containing 8% DMEU, and 0.5% zinc nitrate, 0.3% wetting agent and 91.2% water. The skeins were dried, then wound onto cones and used as the fill in a 4×4 all-cotton basket weave in which the warp had been sized with starch. After the fabric was woven, it was cured for 5 minutes at 160°C, washed and dried. Then it was dyed with 1% Reactive Red 1 using the following standard procedure. Essentially, this consisted of inserting the fabric into an aqueous bath at room temperature containing 1% dye (based on the weight of the water) and 4% sodium sulfate (based on the weight of the water). For each gram of fabric, 30 grams of the bath solution were employed. The samples were stirred for 15 minutes, removed from the bath and 2% sodium carbonate (based on the weight of water) was added. The bath was warmed to 55°C and maintained at that temperature. The fabric was reinserted in the dye bath and stirred for 15 minutes. The fabric was now rinsed in cold water, then heated in a hot bath containing wetting agent. The sample was then laundered.

The sample was now slightly checkered in pattern with the warp yarns dyed red and the filling yarns undyed. The sample was then hydrolyzed for 10 minutes by inserting it in a water bath at 46°C containing 0.25% hydrochloric acid. The sample was rewashed and dried. At this point the fabric was redyed using the standard dye procedure with the dye bath containing 0.15% Reactive Yellow 22 and 0.05% Reactive Blue 41. The result was a crossdyed 4×4 basket weave in which the warp yarns were dyed red and the filling yarns were dyed green.

Desizing of the starch was delayed until completion of all dyeing and hydrolysis steps. The desizing procedure employed is given in Example 17.

EXAMPLE 2

The same procedure was employed as in Example 1 except that for the fill of the fabric, the loom alternated between one inch segments of DMEU treated and untreated yarns. The result after all the dyeing and hydrolysis steps are employed as in Example 1 is a striped fabric consisting of 1 inch of red and 1 inch of red and green crossdyed stripes.

EXAMPLE 3

Undyed fabric from Examples 1 was dyed, hydrolyzed and redyed as in Example 1 except that the dye solution consisted of 1% Reactive Red 1 in the first dyeing and 0.08% Reactive Yellow 22 and 0.02% Reactive Orange 4 in the second dyeing. The result was a crossdyed 4×4 basket weave in which the warp yarns were dyed red and the fill yarns dyed yellow.

EXAMPLE 4

Undyed fabric of the type in Example 2 was dyed, hydrolyzed and redyed as in Example 1 except that the dye solution consisted of 1% Reactive Red 1 in the first dyeing and 0.08% Reactive Yellow 22 and 0.02% Reactive Orange 4 in the second dyeing. The result after all dyeing and finishing is a striped fabric consisting of alternate bands 1 inch wide of red and a red and yellow crossdyed stripe.

EXAMPLE 5

Undyed fabric from Example 1 was dyed, hydrolyzed and redyed as in Example 1 except that a dye formulation consisted of 0.126% Reactive Yellow MX-8G, 0.68% Reactive Turquoise H-7G and 0.19% Reactive Blue MX-2G in the first dyeing and 0.126% Reactive Yellow 22 in the second dyeing. The result is a crossdyed green and yellow basket weave in which the warp yarns were dyed green and the fill yarns were dyed yellow.

EXAMPLE 6

Undyed fabric from Example 2 was dyed, hydrolyzed and redyed as in Example 1 using the dye formulations employed in Example 5. The result is a striped crossdyed fabric in which there are alternating one inch bands of green stripes and green and yellow stripes in which the warp yarns were dyed green and the fill yarns were dyed yellow.

EXAMPLE 7

Undyed fabrics from Example 1 was dyed, hydrolyzed and redyed as in Example 1 except that different dye colors were employed. In the initial dyeing, the bath contained 0.56% Reactive Brown MX5R and 0.10% Reactive Blue MX-2G. In the second dyeing, the bath contained 0.975% Reactive Yellow Mx-8G and 0.025% Reactive Orange MX. The result was a crossdyed 4×4 basket weave in which the warp yarns were dyed brown and the fill yarns were dyed yellow.

EXAMPLE 8

The experimental procedure of Example 7 was repeated using undyed fabric from Example 2. The result was a striped fabric in which a solid brown stripe alternated with a brown and yellow crossdyed stripe in which the warp yarns were dyed brown and the fill yarns were dyed yellow.

EXAMPLE 9

A combination of rib and basket weave was prepared using 2-ply untreated warp yarns and a treated plied filling yarn. The yarns for the fill had been treated in skein form using the DMEU formulation used in Example 1. The dried yarns (singles) were plied prior to use in the fabric. The woven fabric was cured and laundered as in Example 1. Then the fabric was dyed, hydrolyzed and redyed using process and chemicals of Example 1. The result was a crossdyed rib and basket weave fabric in which the warp yarns were dyed red and the fill yarns were dyed green.

EXAMPLE 10

A sample of undyed fabric from Example 9 was dyed using the dyes and process employed in Example 7. The result was a crossdyed rib and basket weave combination in which the warp yarns were dyed brown and the fill yarns were dyed yellow.

EXAMPLE 11

In this example, the same fabric was prepared as in Example 9 except that the fill was prepared by plying a DMEU treated yarn with an untreated yarn. The woven fabric was cured as in Example 1 and then dyed, hydrolyzed and redyed using the process and chemicals as in Example 1. The result was a crossdyed rib and basket fabric having a tweed appearance in which red was the dominant color and green the minor component. This arose because all of the warp yarns were dyed red while the filling yarns were striped because one yarn of the ply was red while the second yarn was green.

EXAMPLE 12

The cured but undyed rib fabric from example 9 was dyed, hydrolyzed and redyed using the procedure of Example 1. However, in the first dyebath, the dye formulation consisted of 0.63% Procion Orange MX-2R in the first dyeing and 0.37% Procion Yellow MX-8G and 0.01% Procion Orange MX-2R in the second dyeing. The result was a crossdyed rib and basket weave fabric in which the warp yarns were dyed orange and the fill yarns were dyed yellow.

EXAMPLE 13

A plied yarn composed of a DMEU treated single yarn and a untreated bleached single yarn was used to knit a 1/1 sweater rib fabric. Then the fabric was dyed, hydrolyzed and redyed using the dye formulations employed in Example 12. The result was a tweedy appearing sweater rib fabric, composed of 2-ply yarns, one of which is orange and one is yellow.

EXAMPLE 14

A cotton warp was sized with a formulation containing 11% DMEU, 4% Polyvinylalcohol (Elvanol 50-42), 0.7% zinc nitrate hexahydrate, 0.3% wetting agent (Triton X-100) and 84.0% water. The warp was dried and then a rib and basket weave combination fabric was prepared using untreated bleached filling. After the fabric was woven, it was cured for 5 minutes at 160°C, then dyed with 1% Reactive Red 1 using the standard dye procedure employed in Example 1. Then, the fabric was hydrolyzed using 0.25% hydrochloric acid as in Example 1 and then the polyvinylalcohol was desized in the normal manner. This consisted of a hot water boil off and repeated washing with water.

At this point the fabric was redyed using the standard dye procedure using 0.1% Reactive Yellow 22. The result was a crossdyed rib fabric in which the filling yarns were dyed red and the warp yarns were dyed yellow.

Similar red and yellow crossdyed fabrics were obtained if the PVA desizing with hot water was performed subsequent to the second dyeing.

EXAMPLE 15

Cured, undyed fabric from Example 14 was finished as in Example 14 except that the dye bath formulations for the first and second dyeings were the same as used in Example 17. The result was a crossdyed rib fabric in which the warp yarns were dyed yellow and the filling yarns were dyed brown.

EXAMPLE 16

Cured, undyed fabric from Example 14 was finished as in Example 14 except that the dye bath formulations for the first and second dyeings were the same as used in Example 9. The result was a crossdyed rib fabric in which the warp yarns were dyed green and the fill yarns were dyed red.

EXAMPLE 17

This is a repeat of Example 14 with the following two exceptions. First, the warp sizing formulation consisted of 11% DMEU, 9% modified starch (Staley K5-136) 0.7% zinc nitrate hexahydrate, 0.3% wetting agent (Triton X-100) and 79.0% water. The other difference was that the fabric was desized using an enayme. This procedure consisted of placing the fabric in a bath containing 0.1% wetting agent and 0.025% Rhozyme DX and the remainder water (acidified to pH 6 with acetic acid). Then the bath was heated to 170°–180°F and sample agitated for 20 minutes. Sample was then given one hot water rinse, a cold water rinse and tumble dried.

If the remainder of the dyeing, hydrolyzing and redyeing procedure was followed as in Example 14, there was obtained a crossdyed red and yellow rib fabric as in Example 14. The filling yarns were dyed red and the warp yarns were dyed yellow.

Similar red and yellow crossdyed fabric was obtained if the desizing was done prior to the hydrolysis or subsequent to the second dyeing. However, if the desizing was performed prior to the initial dyeing, crossdyed fabric was not obtained.

EXAMPLE 18

Cured, undyed fabric from Example 17 was finished as in Example 17 except that the dye bath formulations were the same as in Example 7. The result was a crossdyed rib fabric in which the warp yarns were dyed yellow and the filling yarns were dyed brown.

EXAMPLE 19

Cured, undyed fabric from Example 17 was finished as in Example 17 except that the dye bath formulations for the first and second dyeings were the same as in Example 9. The result was a crossdyed rib fabric in which the warp yarns were dyed green and the fill yarns were dyed red.

EXAMPLE 20

This example is a repeat of Example 1 except that the skeins used for DMEU treatment were prepared from mercerized yarn. After completion of the finishing and dyeing as in Example 1 a crossdyed basket weave fabric with a red warp and a green fill was obtained. However, the green yarns were brighter and deeper in color than the sample in Example 1.

EXAMPLE 21

Undyed, cured fabric from Example 20 was finished and dyed with the formulations used in Example 7. The result was a crossdyed brown and yellow basket weave fabric as obtained in Example 7 except that the yellow fill yarns were dyed a brighter and deeper shade of yellow than the fabric obtained in Example 7.

EXAMPLE 22

This is a repeat of Example 13 except that the DMEU treated yarn (skein treatment with 8% DMEU) had been mercerized prior to the DMEU treatment. The result was an orange and yellow crossdyed tweedy knit, in which one yarn of the ply was dyed orange and the second ply was dyed yellow. The yellow ply was a brighter and deepr shade than the sample in Example 13.

EXAMPLE 23

This is a repeat of Example 14 except that the warp yarns had been mercerized prior to the DMEU and PVA treatment. Otherwise finishing and dyeing procedures were the same as in Example 14. The result was crossdyed rib fabric in which the filling yarns were dyed red and the warp yarns were dyed yellow. The warp yarns were a brighter and deeper yellow than those in Example 14.

EXAMPLE 24

This is a repeat of Example 17 except that the warp yarns had been mercerized prior to DMEU and starch treatment. The result was a crossdyed rib fabric in which the filling yarns were dyed red and the warp yarns were dyed yellow. However, the warp yarns were dyed a brighter yellow than those in Example 17.

EXAMPLE 25

A combination of rib and basket weave fabric was prepared using 2-ply treated warp yarns and untreated plied filling yarns. The yarns for the warp were treated in slashing using the DMEU formulation employed in Example 1. The woven fabric was cured, washed and dried. Then, a sample of the fabric was dyed, hydrolyzed and redyed using the process and chemicals employed in Example 1. The result was a crossdyed rib and basket weave fabric in which the warp yarns were dyed green and the filling yarns were dyed red.

EXAMPLE 26

Some of the cured and undyed fabric from Example 25 was dyed using the dyes and process employed in Example 7. The result was a crossdyed rib and basket weave cotton fabric in which the warp yarns were dyed yellow and the fill yarns were dyed brown.

EXAMPLE 27

A sample of the cured and undyed fabric from Example 25 was bleached using a formulation consisting of 1% $H_2O_2$ and 1.5% sodium silicate for a period of 1 hour at a temperature of 200°F. Then the fabric was rinsed, dried and dyed with the initial dye bath used in Example 1. The dye formulation for this was 1% Reactive Red 1. The fabric at this point was a red and white crossdyed fabric in which the filling yarns were dyed red and the warp yarns were white. A similar orange and white crossdyed fabric was obtained when the dye bath used contained 1% Orange 4. Similarly, a yellow and white crossdyed fabric was obtained when the dye bath in the initial dye formulation contained 1% Reactive Yellow 22.

EXAMPLE 28

Cured, undyed fabric from Example 9 was bleached using the formulation and chemicals employed in Example 27. Then, it was given an initial dyeing with Reactive Red 1 as in Example 27. The result was a red and white crossdyed fabric in which the warp yarns were dyed red and the fill yarns were white. A similar situation arose when the undyed, bleached fabric was dyed with a dyebath containing 1% Orange 4 except now an orange and white fabric was produced. The warp yarns were dyed red and the fill yarns were undyed. Similarly, a yellow and white fabric was produced when the dye bath contained 1% Reactive Yellow 22. Again the warp yarn was dyed yellow and the fill yarns were white.

We claim:

1. A process for producing crossdyed cotton fabrics comprising:

a. crosslinking a cotton yarn with a hydrolyzable crosslinking agent selected from the group consisting of dimethylolethyleneurea and dimethylolpropyleneurea thereby imparting dye resistance to said yarn;

b. combining said crosslinked yarn with an uncrosslinked yarn to form a fabric;

c. dyeing said fabric with a first reactive cotton dye;

d. hydrolyzing the said crosslinking agent in said crosslinked yarn, rendering said yarn dye reactive; and e. dyeing said fabric with a second reactive cotton dye.

2. The process of claim 1 wherein said fabric is bleached prior to dyeing said fabric with said first dye.

* * * * *